United States Patent [19]

McIntyre et al.

[11] Patent Number: 4,481,303

[45] Date of Patent: Nov. 6, 1984

[54] ELECTRODE MATERIAL

[75] Inventors: James A. McIntyre; Robert F. Phillips, both of Midland, Mich.

[73] Assignee: The Dow Chemical Company, Midland, Mich.

[21] Appl. No.: 520,979

[22] Filed: Aug. 8, 1983

Related U.S. Application Data

[63] Continuation of Ser: No. 333,592, Dec. 23, 1981, abandoned.

[51] Int. Cl.[3] ..... H01M 4/86

[52] U.S. Cl. ..... 502/159; 428/403; 428/407

[58] Field of Search ..... 427/115, 122, 113, 125, 427/215, 216, 217, 221; 428/403, 407; 252/425.3; 502/159

[56] References Cited

U.S. PATENT DOCUMENTS

| | | | |
|---|---|---|---|
| 3,985,578 | 10/1976 | Witherspoon | 429/44 |
| 4,043,933 | 8/1977 | Breault et al. | 429/42 |
| 4,054,687 | 10/1977 | Kunz | 427/115 |
| 4,175,055 | 11/1979 | Goller et al. | 252/525.3 |
| 4,244,793 | 1/1981 | Johnson et al. | 204/98 |
| 4,292,197 | 9/1981 | Chamberlin | 252/525.3 |
| 4,299,682 | 11/1981 | Oda | 252/525.3 |

*Primary Examiner*—Norman Morgenstern
*Assistant Examiner*—Richard Bueker

[57] ABSTRACT

A particle suitable for use as an electrode material comprising a substrate at least partially coated with an admixture of a hydrophobic material and an electrochemically active, electrically conductive catalyst.

The invention includes a method for producing the coated particles.

8 Claims, No Drawings

ELECTRODE MATERIAL

CROSS-REFERENCE TO RELATED APPLICATIONS

This is a continuation of application Ser. No. 333,592 filed Dec. 23, 1981 now abandoned.

The invention concerns electrodes. Specifically, the invention is an improved electrode material and a method for producing that material.

BACKGROUND OF THE INVENTION

Chlorine and alkali metal hydroxide, for example, sodium hydroxide and potassium hydroxide, are commercially prepared by the electrolysis of the corresponding alkali metal chloride brines in an electrolytic cell. In one type of cell, where the anode is separated from the cathode by an ion permeable barrier, chlorine is evolved at the anode according to the reaction:

$$2Cl^- \rightarrow Cl_2 + 2e^-$$

while hydroxyl ion is produced at the cathode according to $$2H_2O + 2e^- \rightarrow H_2 + 2OH^-$$

which is actually a multi-step reaction in which a hydrogen species is absorbed onto the surface of the cathode and the hydrogen molecule is desorbed therefrom.

The total hydrogen reaction, as a series of postulated adsorption and desorption steps, consumes about 0.8 volts in an alkaline solution, such that if the cathode in a chlorine cell is depolarized with oxygen instead of being allowed to evolve hydrogen, a savings of about 1.2 volts is possible, since the oxygen reduction reaction can theoretically generate 0.4 V. The cathodes previously developed for utilization of oxygen as a depolarizer were characterized by a structure of a thin sandwich of a microporous separator of plastic combined with a catalyzed layer, wetproofed with, e.g., polytetrafluoroethylene, and pressed onto a wire screen current collector. In the prior art depolarized cathodes, oxygen is fed into the catalyst zone through the microporous backing. Such cathodes work. However, they suffered from various deficiencies, including separation or delamination of the various layers and flooding of the microporous layer.

SUMMARY OF THE INVENTION

This invention includes in its scope a particle suitable for use as an electrode material. The particle has a substrate which is at least partially coated with an admixture of a binder and an electrochemically active, electrically conductive catalyst.

This invention also includes within its scope a method for preparing particles suitable for use as an electrode material. The particles are prepared by forming a fluid admixture of a particulated substrate, an electrically conductive, electrochemically active catalyst and a binder. The catalyst is then bonded to the substrate by solidifying the fluid admixture.

DETAILED DESCRIPTION OF THE INVENTION

The invention is a particle suitable for use as an electrode material and a process for producing the particle. The particle itself is a coated particle having a substrate with an electrically conductive coating at least partially covering the substrate. A bed of these particles has been found to be useful as a gas electrode. The electrode may be used as a cathode or as an anode.

The substrate, upon which a coating is applied, should be a material which will hold its shape. To provide for a convenient method of preparing the hereindescribed particles, the substrate is preferably a material which will not substantially deform when heated to a temperature of 350°-375° C. for a period of 1 hour.

The substrate may be a sintered material, a solid material, or a bonded agglomeration of small particles. Suitable materials of construction include, but are not limited to steel, iron, graphite, nickel, platinum, copper, and silver. Particularly preferred is graphite, because of its availability and its low cost. The substrate may be of the same composition or of a different composition than that of the coating.

The substrate may be electrically conductive or electrically nonconductive. Electrically conductive substrates are preferred becuase they offer less resistance to the flow of electrical energy through the particles. Nonconductive substrates are operable because they are at least partially coated with an electrically conductive coating, thus providing a pathway for the flow of electrical current. However, nonconductive substrates offer greater resistance because the electrical charge must flow around the particle through its coating, rather than through the particle.

The size of the substrate may be smaller than about 0.3 mm to as large or larger than about 2.5 cm. For use as an electrode material, it is preferred to use generally smaller substrates. This maximizes the surface area and gives a high porosity to the bed of particles. Substrates having a size of from about 4 mm to about 0.7 mm are particularly preferred when the particles are used as an electrode material. Substrates smaller than about 0.3 mm tend to pack and offer a high resistance to fluid flow through the bed of particles. Substrates larger than about 2.5 cm are not preferred because there is a minimum amount of surface area for electrical chemical reactions to occur.

The substrate may be of any shape. Irregularly shaped substrates as well as spherical substrates may be conveniently used. Spherical substrates are generally preferred because they form a bed having optimum porosity and surface area. Irregularly shaped substrates tend to pack and minimize the porosity of the bed.

The substrate need not be chemically inert to the electrolyte or the products of electrolysis of the process in which the particle is used. Preferably, however, the substrate is chemically inert so the coating need not totally cover the substrate. If the substrate is not chemically inert, the coating applied thereto should be a complete coating to prevent reaction between the substrate and the electrolyte or the products of electrolysis.

The coating on the substrate is an admixture of a binder and an electrochemically active, electrically conductive catalyst. The binder should be a material which may be put into a fluid form by melting, dispersing, or dissolving. The binder should be chemically stable to any electrolyte or products it will contact wihen in use in an electrolytic cell. The binder should be firmly stable at the temperature of operation for the electrochemical cell in which it will be used. The binder need not itself be electrically conductive, since the catalyst mixed with it is electrically conductive. The coating may be a porous coating or a nonporous coating depending on the materials of construction of the substrate. If the substrate is chemically inert to the electrolyte, the coating may be a porous coating. If, however, the substrate is not chemically inert to the electrolyte, the coating should be nonporous to prevent reactions between the substrate and the electrolyte or electrolytic products from occurring.

Preferably, the binder is a hydrophobic material. When used as an electrode material, the hydrophobic binder will cause bubbles to form on the surface of the particles and provides maximum contact between the gas and the liquid. If the binder is not hydrophobic, the surfaces of the particles will be wetted and no bubbles will form.

Various types of hydrophobic material may be used as a binder. The hydrophobic material may be a polyfulorocarbon, for example, polytetrafluoroethylene, polychlorotrifluoroethylene, polytrifluoroethylene, polyvinylfluoride, polyvinylidene fluoride and copolymers, including interpolymers and terpolymers having tetrafluoroethylene, trifluoroethylene, chlorotrifluoroethylene, vinylidene fluoride and vinyl fluoride. Particularly preferred is polytetrafluoroethylene.

The particles also contain in the coating an electrochemically active, electrically conductive catalyst. The selection of the catalyst will depend upon the type of process to which the electrode material will be put. Examples of such processes include the reduction of oxygen and the oxidation of hydrogen. For the reduction of oxygen, the preferred catalysts include such things as carbon blacks, platinum, silver and activated carbon. Carbon black is particularly preferred because of its good physical characteristics and its availability. Preferred are carbon black catalysts having surfaces areas of from about 100 to about 1,000 square meters per gram of catalyst. Particularly preferred are those having a surface area from about 150 to about 500 square meters per gram of catalyst.

The substrate may be partially or fully coated with the binder catalyst mixture. Preferably, the coating covers substantially the entire surface of the particle. The coating may be of any convenient thickness. Thicknesses of about 1 mil are particularly preferred. This provides an adequate coating to cover substantially the entire surface of the particle, yet is sufficiently thin to conserve the catalyst-binder mixture required to cover the particle. Thickness in excess of about 5 to about 6 mils are wasteful in that a substantial portion of the catalyst is unavailable for reaction since it is covered by additional catalyst and binder.

Optionally, the coating may include a peroxide decomposition catalyst. As is herein-contemplated, the peroxide decomposition catalyst may be both on the exterior surface of the particle as well as in the internal surface of the particle. Preferred is a particle in which the peroxide decomposition catalyst is on the exterior surface of the substrate because no catalyst is wasted since unexposed catalyst is ineffective.

The peroxide decomposition catalyst is typically a transition metal having hydrogen adsorption properties. Such metals are chosen from the group consisting of chromium, manganese, technetium, rhenium, iron, cobalt, nickel, ruthenium, rhodium, palladium, osmium, iridium, platinum, copper, silver, gold, zinc, cadmium, mixtures thereof, and compounds thereof. Especially preferred peroxide decomposition catalysts include copper, silver, gold, mixtures thereof, and compounds thereof. Silver, platinum and mixtures thereof, and compounds thereof with carbon black are especially preferred. Particularly preferred is silver acetate.

Another particularly desirable class of peroxide decomposition catalysts are compounds of (1) alkali metals, alkaline earth metals, and metals of Group IIIB, with (2) transition metals, which compounds are further characterized by electrocatalytic or surface catalytic properties. Especially preferred are the perovskites. Groups of perovskites especially useful in this invention are (1) oxycompounds of alkali metals with molybdenum or tungsten, i.e., alkali metal tungstates, especially sodium and potassium tungstates and sodium and potassium molybdates, (2) oxycompounds of alkaline earth metals with platinum group metals, i.e., alkaline earth ruthenates, alkaline earth ruthenites, alkaline earth rhodates, alkaline earth rhodites, alkaline earth osmates, and alkaline earth osmites, where the alkaline earth metals are magnesium, calcium, strontium, and barium; and (3) oxycompounds of lanthanides, including scandium, with transition metals of Group VIII of the Periodic chart, especially cobalt, to form lanthanide cobaltates, e.g., $LaCoO_3$.

The invention includes within its scope a method for the production of coated particles suitable for use as an electrode material. The coated particles are prepared by forming a fluid admixture of a particulated substrate, an electrochemically active, electrically conductive catalyst and a binder. The catalyst is bonded to the substrate by solidifying the fluid admixture. This forms a particle having a substrate at least partially coated with a binder and a catalyst.

The fluid admixture is initially formed by blending a particulated substrate with a catalyst and a binder. The admixture may be made fluid in one of several ways. The binder, itself, may be heated to a temperature at which it is softened or melted. It may be softened or melted prior to being mixed with the catalyst and the substrate or in situ with the catalyst and substrate. The softening point or melting point of various materials suitable as binders are well known to those skilled in the art. They can be found in many reference books or handbooks of chemistry.

An alternative method of forming the fluid admixture is to disperse the binder, catalyst and substrate in a liquid medium. Various liquid mediums which are nonreactive with the three components of the admixture may be used. Particularly preferred are water or other liquid materials which are not solvents for any of the components of the admixture. The dispersion may be made after the components have been admixed or any one of the components may be dispersed in a liquid prior to being blended with the other components. It is important to have the components adequately dispersed in the liquid medium.

A third way of forming the liquid admixture is to dissolve the binder in a solvent. The dissolved binder may then be admixed with the catalyst and the substrate. The solvent should not have the ability to dissolve neither the substrate nor the catalyst. The binder may be dissolved after or before the components have been blended.

After the fluid admixture has been formed, it is solidified to bind the catalyst to the substrate. The admixture may be solidified in one of several different ways. The solidification method is somewhat dependent upon the method initially used to form the fluid admixture. If the fluid admixture was formed by melting or softening the binder, mere cooling of the admixture will cause the binder to solidify. If the fluid admixture was formed by dispersing one or more of the components into a liquid medium, solidification may be caused by removing the liquid medium from the admixture. The liquid medium may be removed by heating the admixture to evaporate the liquid medium or by subjecting the admixture to a vacuum to vaporize the liquid medium. If the method used to form the liquid admixture was dissolving the binder in a solvent, solidification may be accomplished by removing the solvent. The solvent may be removed by heating to vaporize the solvent, by vacuum to remove the solvent, or by reacting the solvent with another component.

Optionally, the admixture, during solidification may be treated in a manner to prevent the coated particles from adhering together to form one, single mass. Agitation is a convenient way to prevent the particles from adhering to each other during the solidification process. The amount and severity of agitation used is minimal and can be accomplished by merely stirring or rolling the material during solidification. Agitation during solidification also helps enhance the uniformity of the coating onto the substrate.

Optionally, after solidification, the coated particles may be heated to a temperature near or above the softening point of the binder to enhance the bonding of the material to the substrate. Heating to this temperature causes the binder to soften and become more intermixed with the catalyst and better bonded to the substrate.

Optionally, the steps of coating the particle may be repeated a plurality of times. In this manner, the amount and thickness of the coating may be controlled depending on the number of times the process is repeated. The thickness of the coating is not critical to the invention.

Optionally, a surfactant may be added to the fluid admixture to enhance wetting of the substrate and the catalyst by the binder. This assures better contact and a more even distribution of the admixture. It is preferred that a type of surfactant be used that may be removed from the particle after the bonding has occurred. This is preferred because, when in use as an electrode material, the coated particle preferably is not wetted by the electrolyte. As was discussed earlier, the formation of gas bubbles on the surface of the particle is desired. The presence of a surfactant at this point would minimize the formation of gas bubbles since the wetting of the particles by an electrolyte would be enhanced. As a result, the preferred surfactants are the non-ionic surfactants which may be thermally decomposed leaving only a carbon residue. Such surfactants are well-known in the art and need no further elaboration.

Optionally, the particles may be washed after bonding to remove any catalyst which has not been bonded to the substrate. Water and other liquds which are not solvents for any of the components of the coating are suitable. Water is particularly preferred because of its convenience.

The weight or volume ratio of the catalyst and binder to the substrate depends on the degree of coating desired on the substrate. If a small amount of coating is desired, obviously only a small amount of catalyst and binder should be blended with the substrate to form a fluid admixture. Conversely, if a thick coating is desired, the amount of catalyst and binder should be increased.

The ratio of the amount of catalyst to the amount of binder may be varied over a rather wide range. For example, if carbon black is used as the catalyst, and polytetrafluoroethylene is used as the binder, weight ratios of about 4:1 to about 1:4 may be used. Preferred ratios of carbon black to PTFE are from about 1:1.5 to about 1.5:1 by weight. Other catalyst and binders should also be used within this same general ratio.

If a metal powder is used as the catalyst, such as silver, platinum or other metals, it is convenient to express the proportion in terms of volume as opposed to weight. The metal powder to binder may be in the range of about 4:1 to about 1:4, by volume. Preferably, the ratio should be from about 1:1.5 to about 1.5:1, by volume.

Optionally, various types of additional catalysts may be added to the fluid admixture. One of the preferred embodiments of the herein-described invention includes the addition of a peroxide decomposition catalyst, in conjunction with a carbon black catalyst. When both of these types of catalyst are used about 1 to about 35 weight percent of the total catalyst used should be a peroxide decomposition catalyst and about 65 and about 99 percent of the total amount of catalyst used should be the carbon black catalyst. Preferably, about 3 to about 10 percent of the catalyst should be the peroxide decomposition catalyst and about 90 to about 97 percent of the catalyst should be the carbon black catalyst. This catalyst mixture should be used in the ratios discussed earlier concerning the catalyst to binder ratio.

Commonly, the peroxide decomposition catalyst used to form the fluid admixture is a precursor catalyst. In other words, the material used in the fluid admixture is a compound of the catalyst, which must be thermally or chemically decomposed in order to form the catalyst itself. This thermal or chemical decomposition may be accomplished at any stage of the process of forming the coated particles. Preferably, the material is thermally or chemically decomposed prior to being mixed with the binder and the substrate. This allows better control of the thermal or chemical decomposition of the catalyst precursor. Additionally, it provides the maximum contact between the carbon black and the peroxide decomposition catalyst. If the two are blended and decomposed prior to being mixed with the substrate and the binder, maximum contact is obtained between the carbon black and the peroxide decomposition catalyst.

The herein-described coated particles are suitable for use as an electrode material, since they are electrically conductive and catalytically active. Conveniently, they may be used as a packed bed electrode. As such, they are formed into a bed and supported in some convenient manner within the cell. They are electrically connected with a power supply associated with the cell. Optionally, a current collector may be used. The current collector may be a wire mesh bag, wire mesh container or the like, surrounding the catalyzed particles and containing them therein.

If the coated particles include a peroxide decomposition catalyst, the particles may be used in a cell to produce a hydroxide. If the coated particles do not contain a peroxide decomposition catalyst, the particles may be used in a cell to produce a peroxide.

According to a preferred embodiment of the method of using the herein-described particles, an aqueous alkali metal halide brine is fed to an electrolytic cell having an anolyte compartment with an anode therein, and a catholyte compartment with cathode means therein, and optionally an ion permeable barrier therebetween. Typically, the anode is a valve metal, for example, titanium, tantalum, tungsten, columbium, or the like, with a suitable electrocatalytic surface thereon. Suitable anodic electrocatalytic surfaces are well known in the art and include transition metals, oxides of transition metals, compounds of transition metals, especially platinum group metals, oxides of platinum group metals and compounds of platinum groups metals. Especially preferred are compounds of oxides of platinum groups metals with oxides of the valve metals, that is, titanium, tantalum, tungsten, columbium and the like.

The ion permeable barrier may be an electrolyte permeable diaphragm, for example, a deposited asbestos diaphragm, a preformed asbestos diaphragm, or a microporous synthetic diaphragm. Alternatively, the ion permeable barrier may be ion permeable but electrolyte impermeable as a cation selective permionic membrane. Typically, cation selective permionic membranes are fluorocarbon polymers having pendent acid groups thereon. Typical pendent acid groups include sulfonic acid groups, carboxylic acid groups, phosphonic acid groups, phosphoric acid groups, precursors thereof, and reaction products thereof.

The anolyte liquor is typically an aqueous brine containing from about 120 to about 250 grams per liter of sodium chloride or from about 180 to about 370 grams per liter of potassium chloride, and is typically at a pH of from about 1.5 to about 5.5. The brine feed is typically a saturated or substantially saturated brine, containing from about 300 to about 325 grams per liter of sodium chloride or from about 450 to about 500 grams per liter of potassium chloride. The catholyte liquor recovered from the electrolytic cell may be a catholyte liquor containing approximately 10 to 12 weight percent sodium hydroxide and 15 to 25 weight percent sodium chloride, or approximately 15 to 20 weight percent potassium hydroxide and approximately 20 to 30 weight percent potassium chloride, as where an electrolyte permeable barrier is utilized. Alternatively, the catholyte product may contain from about 10 to about 45 weight percent sodium hydroxide, or about 15 to about 65 weight percent potassium hydroxide, as where the ion permeable barrier is a cation selective permionic membrane interposed between the anode and the cathode.

An oxidant, for example, oxygen, air or oxygen-enriched air, is preferably fed to the catholyte compartment as an electrical current is fed from the cathode compartment to the anode compartment, to provide an anode product of chlorine and a cathode product of alkali metal hydroxide, characterized by the substantial absence of gaseous hydrogen product. The invention is particularly directed to a preferred packed bed cathode including coated particles as herein described.

According to a further exemplification of the invention, there is provided an electrolytic cell having an anolyte compartment fabricated of a material resistant to concentrated, chlorinated alkali metal chloride brines, an anode in the anolyte compartment, a catholyte compartment that is fabricated of a material resistant to concentrated alkali metal hydroxide solutions, cathode means in said cathode compartment, and an ion permeable barrier interposed between the anode and the cathode means. The electrolytic cell herein contemplated is characterized by the catholyte compartment having means for feeding an oxidant to the electrolyte within the cathode compartment and cathode means which comprise individual particles.

In another preferred embodiment of the method of using the herein described particles to produce a peroxide aqueous hydroxide solution is fed to the electrolytic cell already described except no ion exchange membrane is used. The anolyte feed is typically an aqueous solution containing from about 15 to about 100 grams per liter of sodium hydroxide. The catholyte liquor recovered from the electrolytic cell may be a catholyte liquor containing approximately 0.5 to 3 weight percent hydrogen peroxide and 15 to 100 grams per liter sodium hydroxide.

As herein contemplated, an oxidant, for example, oxygen, air or oxygen-enriched air, is fed to the catholyte compartment as an electrical current is fed from the cathode compartment to the anode compartment, whereby to provide an anode product of oxygen and water and a cathode product of an alkali metal hydroxide and a peroxide, characterized by the substantial absence of gaseous hydrogen product. The invention is particularly directed to the cathode means for carrying out the reaction, which cathode means comprise coated particles as herein described.

According to a further exemplification of the invention, there is provided an electrolytic cell having an anolyte compartment fabricated of a material resistant to concentrated, alkali metal hydroxide solutions, an anode in the anolyte compartment, a catholyte compartment that is fabricated of a material resistant to concentrated alkali metal hydroxide solutions, cathode means in said cathode compartment, and an ion permeable barrier interposed between the anode and the cathode means. The electrolytic cell herein contemplated is characterized by the catholyte compartment having means for feeding an oxidant to the electrolyte within the cathode compartment and cathode means which comprise individual porous particles.

EXAMPLE 1

To prepare a catalytically active coating, 0.7 gram of carbon black was blended with 20 milliliters of an aqueous silver acetate solution having a concentration of 10 grams of silver acetate per liter of solution. A drop of surfactant (Triton ®X-100) was added to enhance the wetting of the carbon black. The mixture was then oven dried at about 100° C. Thereafter, the mixture was heated for 1 hour at 350° C. in a nitrogen atmosphere to thermally decompose the silver acetate. This material was then blended with 3.5 grams of a 1:10 aqueous emulsion (1 part Teflon 30B fluoropolymer to 10 parts water). A slurry was formed therebetween. To the slurry, 10 grams of −10 +20 U.S. Mesh graphite particles were added. After mixing, the material was dried at about 100° C. Thereafter, the material was heated for 1 hour at 350° C. in a nitrogen atmosphere. The particles produced were graphite particles having a carbon-fluorocarbon-silver coating on their surfaces.

EXAMPLE 2

An electrolytic cell was assembled as described herein. The cell had an anode and a cathode separated by a porous asbestos diaphragm. The cathode was a packed bed of the particles produced in Example 1. The anode was ruthenium oxide coated titanium.

A sodium chloride brine solution having a concentration of about 300 grams per liter of NaCl was flowed into a compartment containing the anode. Oxygen gas was flowed into the openings between the particles comprising the cathode. Electrical current at a voltage of about 2 volts and at a current density of about 1 amp per square inch, was passed between the anode and the cathode to cause electrolysis of the brine solution to occur. Chlorine gas was produced at the anode and sodium hydroxide was produced at the cathode.

What is claimed is:

1. A particle suitable for use as an electrode material comprising:

a generally spherical substrate selected from the group of materials consisting of steel, iron, graphite, nickel, platinum, copper and silver, said substrate being substantially completely coated with an admixture of a hydrophobic binder and an electrochemically active, electrically conductive catalyst selected from the group consisting of silver, carbon black, platinum, activated carbon and mixtures thereof wherein said particle has a diameter of from about 0.7 mm to about 2.5 cm and said coating has a thickness of from about 1 mil to about 5 mils.

2. The material of claim 1 wherein the catalyst is active for the reduction of oxygen.

3. The material of claim 2 wherein the catalyst has a surface area of from about 100 to about 1,000 square meters per gram of catalyst.

4. The material of claim 3 wherein the catalyst has a surface area of from about 150 to about 500 square meters per gram of catalyst.

5. The material of claim 1 wherein the substrate is electrically conductive.

6. The material of claim 1 wherein the binder is a solid fluorocarbon.

7. The material of claim 6 wherein the solid fluorocarbon is polytetrafluoroethylene.

8. The material of claim 1 wherein the catalyst is carbon black.

* * * * *